US007861530B2

(12) United States Patent
Hawie et al.

(10) Patent No.: US 7,861,530 B2
(45) Date of Patent: Jan. 4, 2011

(54) COMBUSTOR FLOATING COLLAR WITH LOUVER

(75) Inventors: Eduardo Hawie, Woodbridge (CA); Lorin Markarian, Etobicoke (CA); Parthasarathy Sampath, Mississauga (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 920 days.

(21) Appl. No.: 11/693,793

(22) Filed: Mar. 30, 2007

(65) Prior Publication Data

US 2008/0236169 A1 Oct. 2, 2008

(51) Int. Cl.
*F02C 1/00* (2006.01)
*F02G 3/00* (2006.01)

(52) U.S. Cl. ..... 60/752; 60/756

(58) Field of Classification Search ..... 60/752–760
See application file for complete search history.

(56) References Cited

U.S. PATENT DOCUMENTS

| | | | | | |
|---|---|---|---|---|---|
| 2,669,090 | A | | 2/1954 | Jackson | |
| 3,169,367 | A | | 2/1965 | Hussey | |
| 3,608,309 | A | | 9/1971 | Hill et al. | |
| 4,226,088 | A | | 10/1980 | Tsukahara et al. | |
| 4,246,757 | A | | 1/1981 | Heberling | |
| 4,322,945 | A | * | 4/1982 | Peterson et al. | 60/800 |
| 4,365,470 | A | * | 12/1982 | Matthews et al. | 60/800 |
| 4,454,711 | A | * | 6/1984 | Ben-Porat | 60/800 |
| 4,475,344 | A | | 10/1984 | Mumford et al. | |
| 4,590,769 | A | | 5/1986 | Lohmann et al. | |
| 4,702,073 | A | | 10/1987 | Melconian | |
| 5,129,231 | A | | 7/1992 | Becker et al. | |
| 5,165,226 | A | | 11/1992 | Newton et al. | |
| 5,307,637 | A | | 5/1994 | Stickles et al. | |
| 5,398,509 | A | | 3/1995 | North et al. | |
| 5,509,270 | A | * | 4/1996 | Pearce et al. | 60/740 |
| 5,590,531 | A | | 1/1997 | Desaulty et al. | |
| 5,894,732 | A | * | 4/1999 | Kwan | 60/756 |
| 5,956,955 | A | | 9/1999 | Schmid | |
| 6,427,446 | B1 | | 8/2002 | Kraft et al. | |
| 6,679,063 | B2 | * | 1/2004 | Ebel | 60/798 |
| 6,880,341 | B2 | * | 4/2005 | Parkman et al. | 60/740 |
| 7,134,286 | B2 | * | 11/2006 | Markarian et al. | 60/796 |
| 7,140,189 | B2 | * | 11/2006 | Markarian et al. | 60/796 |
| 7,478,534 | B2 | * | 1/2009 | Guezengar et al. | 60/796 |
| 7,509,813 | B2 | * | 3/2009 | Stastny | 60/804 |
| 7,543,383 | B2 | * | 6/2009 | Patel et al. | 29/890.142 |
| 7,628,019 | B2 | * | 12/2009 | Tanner et al. | 60/748 |
| 2003/0213249 | A1 | | 11/2003 | Pacheco-Tougas et al. | |
| 2008/0092546 | A1 | * | 4/2008 | Stastny et al. | 60/752 |
| 2009/0000303 | A1 | * | 1/2009 | Patel et al. | 60/752 |

OTHER PUBLICATIONS

U.S. Appl. No. 11/551,021, filed Oct. 19, 2006, Stastny et al.

* cited by examiner

*Primary Examiner*—William H Rodríguez
(74) *Attorney, Agent, or Firm*—Ogilvy Renault LLP

(57) ABSTRACT

A gas turbine combustor is provided with a dome heat shield having a fuel nozzle opening, the opening receiving a floating collar assembly for permitting relative movement between nozzle and heat shield. The floating collar is provided with a louver to provide film cooling to the face of the combustor heat shield and, thus, improve cooling thereof.

20 Claims, 3 Drawing Sheets

COMBUSTOR FLOATING COLLAR WITH LOUVER

FIELD OF THE INVENTION

The present invention relates to gas turbine engine combustors and, more particularly, to a combustor floating collar and heat shield assembly.

BACKGROUND OF THE ART

Gas turbine combustors are the subject of continual improvement, to provide better cooling, better mixing, better fuel efficiency, better performance, etc. at a lower cost. For example, heat shields are known to provide better protection to the combustor, but heat shields also require cooling. Cooling of the downstream or combustion side of the heat shield is challenging and there is a continuing need for improvement in order to ensure constant and effective cooling to this heat shield area.

SUMMARY

It is therefore an aim of the present invention to provide improved cooling.

Therefore, there is provided a floating collar and heat shield assembly for allowing relative movement between a combustor and a fuel nozzle while providing sealing therebetween, comprising an axially extending floating collar body adapted to be mounted in a fuel nozzle opening defined in the combustor, the axially extending floating collar body defining a passage adapted to be aligned with the fuel nozzle opening for receiving the fuel nozzle, the floating collar body having an upstream end adapted to extend into the combustor, the upstream end being provided with a radially disposed annular louver, a heat shield fitted about said floating collar body downstream of said annular louver, said louver and said heat shield defining a controlled gap therebetween, and a sealing ring mounted to said floating collar body downstream of said heat shield and in sealing engagement therewith, said sealing ring defining at least one hole for feeding cooling air to said controlled gap.

In accordance with another general aspect, there is provided a floating collar and heat assembly for gas turbine engine combustor, comprising a heat shield adapted to be mounted in the combustor, the heat shield defining a central aperture, a collar floating received in said central aperture for receiving a fuel nozzle, the central aperture accommodating radial excursion of said collar relative to the heat shield, the collar having a front end portion projecting forwardly of a front side of the heat shield and a rear end portion projecting rearwardly of a rear side of the heat shield, a cooling louver provided at said front end portion of said collar for directing a fluid cooling film along said front side of said heat shield, and a sealing ring provided at said rear end portion of the collar for sealing engagement with said rear side of said heat shield.

In accordance with a further general aspect, there is provided a gas turbine engine combustor comprising a shell enclosing a combustion chamber, a fuel nozzle opening defined in the combustor shell, a floating collar mounted in said fuel nozzle opening and having a downstream end portion projecting into said combustion chamber, the floating collar defining an axial aperture, a fuel nozzle slidably engaged in said axial aperture, a heat shield fitted about said floating collar between the shell and a laterally extending louver integral to said downstream end portion of the floating collar, the louver and the heat shield defining a controlled gap connected in flow communication with a source of coolant, the louver directing a film of coolant along a hot front surface of the heat shield.

In accordance with a further general aspect, there is provided a method of providing a floating collar and heat shield assembly, comprising: providing a collar body having first and second axially opposed ends, said first end having a radially outwardly extending flange; providing a heat shield having a central aperture having an inner diameter greater than an outer diameter of said collar body but smaller than said flange, loosely fitting said heat shield over said collar body from said second end opposite said flange, and trapping the heat shield between the flange and a sealing ring by mechanically attaching the sealing ring to the collar body.

BRIEF DESCRIPTION OF THE DRAWINGS

Reference is now made to the accompanying figures, in which.

DESCRIPTION OF THE PREFERRED EMBODIMENTS

Figure 1:
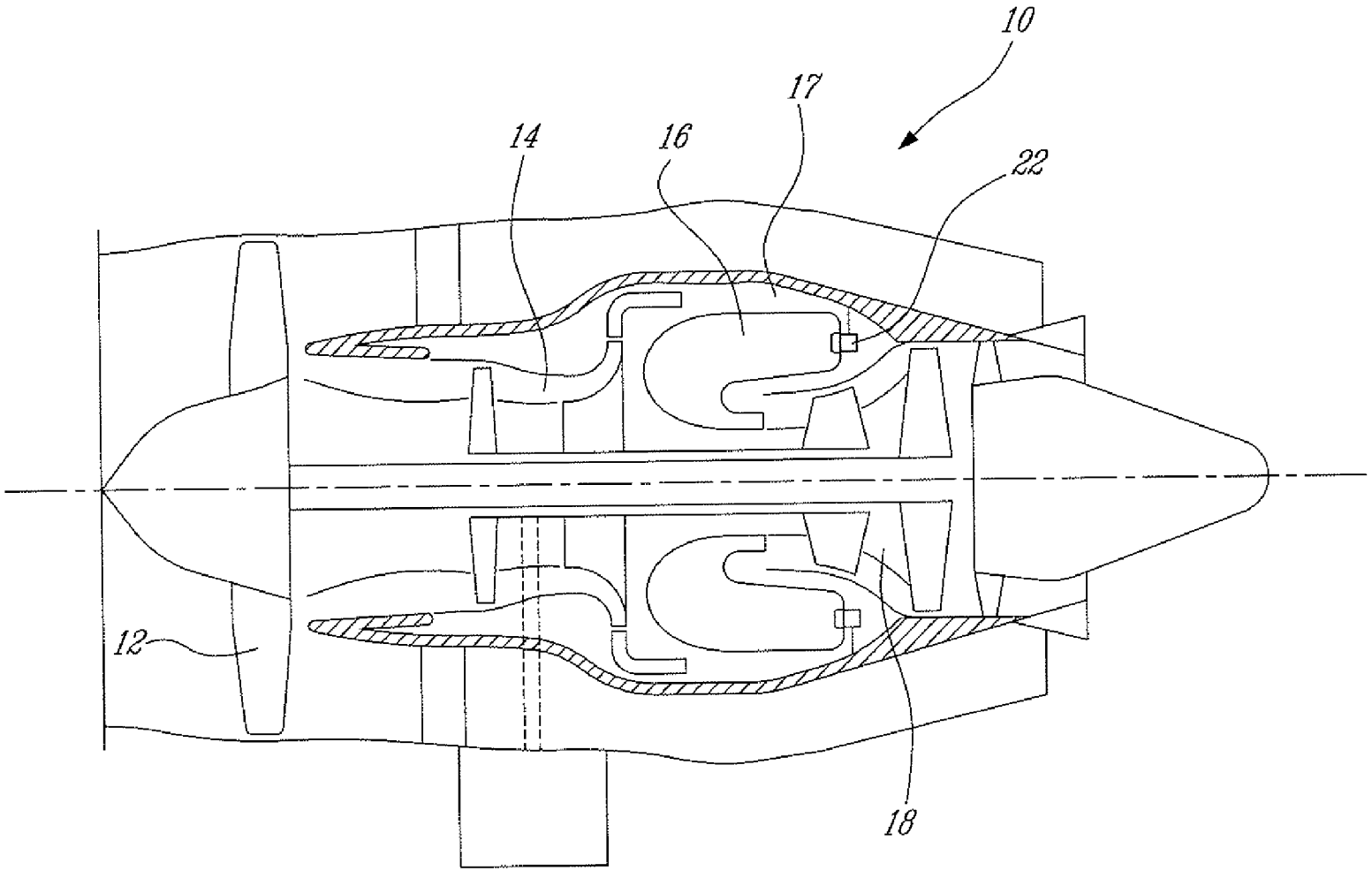
FIG. 1 is a schematic cross-sectional view of a gas turbine engine having an annular combustor.

FIG. 1 illustrates a gas turbine engine 10 generally comprising in serial flow communication a fan 12 (not provided with all types of engine) through which ambient air is propelled, a multistage compressor 14 for pressurizing the air, a combustor 16 in which the compressed air is mixed with fuel and ignited for generating an annular stream of hot combustion gases, and a turbine 18 for extracting energy from the combustion gases.

Figure 2:
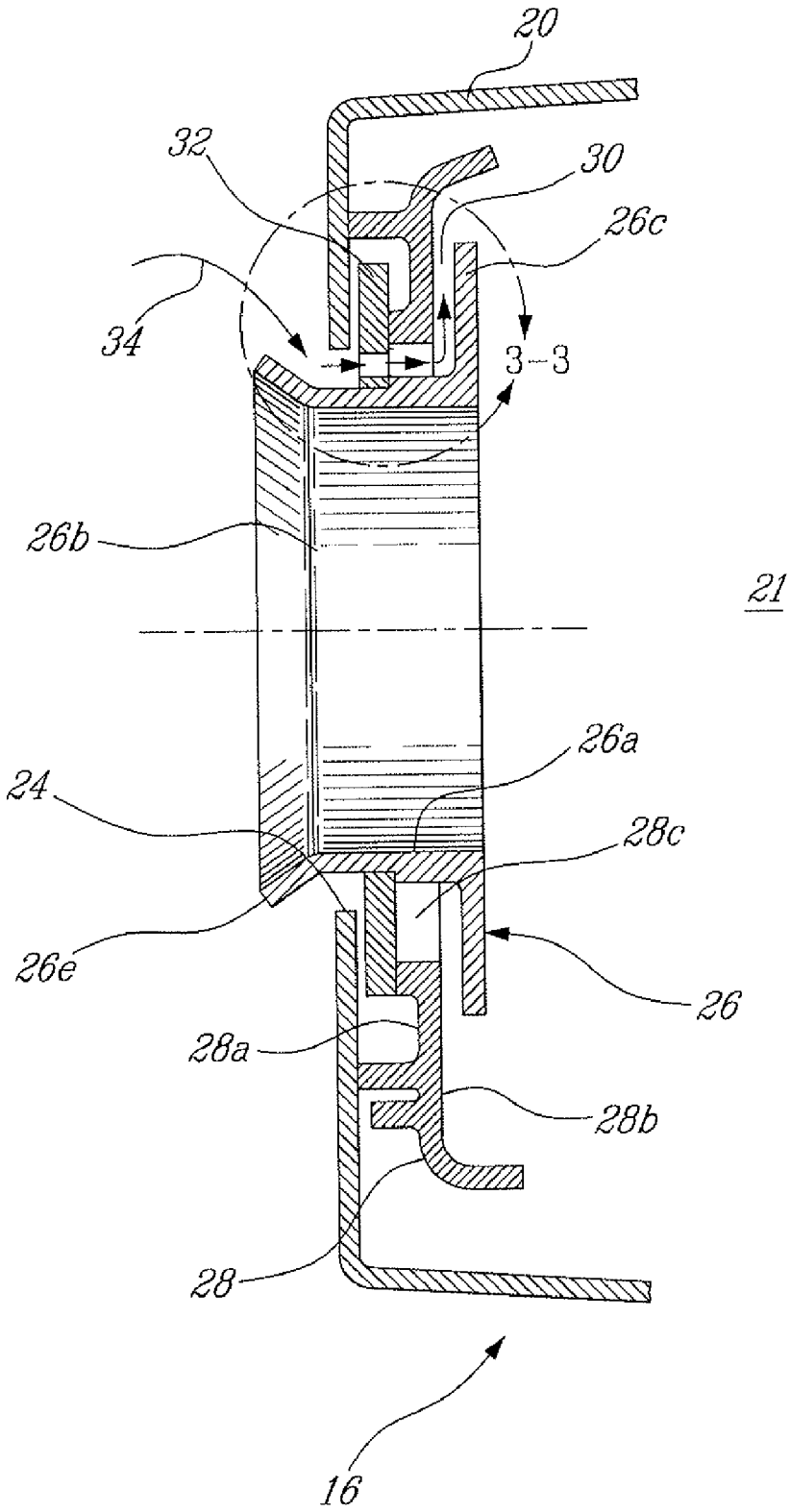
FIG. 2 is an enlarged cross-sectional view of a dome portion of the combustor, showing a splash louver on a floating collar to provide film cooling to the hot front face of a dome heat shield.

The combustor 16 is housed in a plenum 17 supplied with compressed air from the compressor 14. As shown in FIG. 2, the combustor 16 comprises a combustor shell 20, typically formed by sheet metal inner and outer liners, defining a combustion chamber 21. A plurality of circumferentially spaced-apart fuel nozzles 22 (FIG. 1) are typically mounted in respective fuel nozzle openings 24 defined in a dome or bulkhead portion of the combustor shell 20. As shown in FIG. 2, a floating collar 26 is mounted in each opening 24 to allow relative movement between the fuel nozzle 22 and the combustor shell 20 while minimizing leakage therebetween. Each floating collar 26 has an axially extending tubular body portion 26*a* defining a central passage 26*b* adapted to axially slidably receive one fuel nozzle 22.

A dome heat shield 28, typically made out of a cast material, is loosely fitted about each floating collar 26 and fixedly secured to the combustor shell 20 by suitable fastening means, such as bolting or brazing. The heat shield 28 has a central aperture 28*c* which is oversized relative to the body portion 26a of the collar 26 in order to accommodate radial movement of the collar 26 and the fuel nozzle 22 relative to the combustor shell 20 and the heat shield 28.

The rear or upstream surface 28*a* of the heat shield 28 is generally cooled by means of impingement augmented by the use of pin fins (not shown) provided at the back thereof. A combination of impingement and effusion cooling can also be used. Impingement holes (not shown) are typically defined through the dome portion of the combustor shell 20 to cause cooling air from the plenum 17 to impinge upon the upstream surface 28*a* of the heat shield 28.

Figure 3:
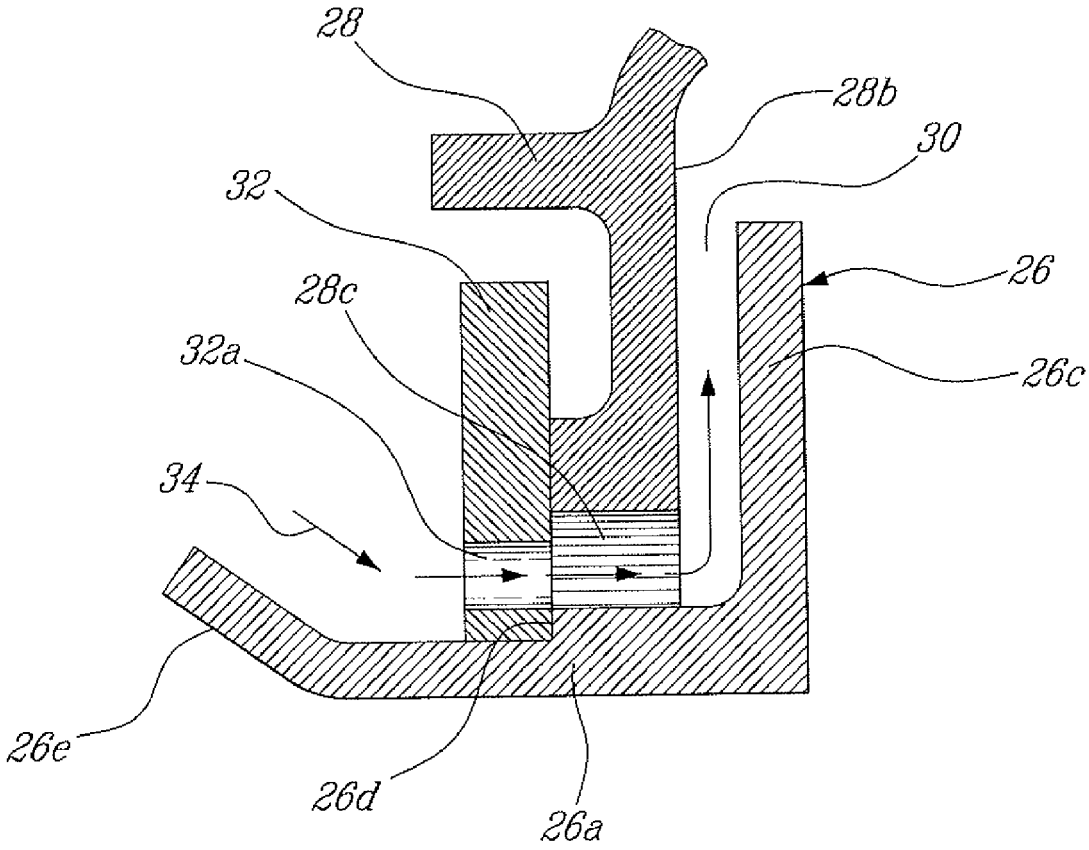
FIG. 3 is enlarged view of details 3 shown in FIG. 2.

Film cooling is used to cool down the front or downstream surface 28*b* of the heat shield 28. As shown in FIGS. 2 and 3, the floating collar 26 is provided at a front or downstream end thereof with a integral flange acting as splash louver 26*c* to provide film cooling to the downstream surface 28*b* of the heat shield 28. The integration of the louver 26*c* to the floating collar body 26*a* greatly simplifies the cooling of the downstream surface 28b of the heat shield 28. The floating collar body 26*a* and the louver 26*c* are of unitary construction and can be made out of a same combination of suitable materials to provide the best durability in wear and oxidation resistance. For instance, high temperature casting materials could be used. The louver 26*c* extends radially outwardly from the downstream end of the body portion 26*a* about passage 26*c*. The louver 26*c* is generally parallel to the front face or downstream surface 28*b* of the heat shield 28 and is spaced axially therefrom so as to form a controlled gap or plenum 30.

A sealing ring 32 is fixedly mounted on the collar body 26*a* for sealing engagement with a corresponding sealing interface on the upstream surface 28*a* of the heat shield 28. The sealing ring 32 can be mechanically attached or joined to the collar body 26*a* by any suitable means, such as welding or brazing. The sealing ring 32 is preferably abutted against a localization shoulder 26*d* (FIG. 3) defined in the outer surface of the collar body 26*a*. A plurality of circumferentially distributed holes 32*a* are defined in the scaling ring 32 for feeding cooling air from the plenum 17 to the controlled gap 30 as depicted by arrows 34 in FIGS. 2 and 3. The holes 32*a* communicate with the controlled gap 30 via the annular gap between the heat shield 28 and the collar 26. The annular gap results from the oversizing of the heat shield central passage 28*c* for accommodating the relative movement between the fuel nozzle 22 and the combustor shell 20 and, thus, the relative movement between the floating collar 26 and the heat shield 28. It is understood that other cooling holes could be defined through the heat shield 28 for allowing the cooling air to flow into the controlled gap 30. The louver 26*c* directs the cooling air flowing into the controlled gap 30 along the downstream surface 28*b* of the heat shield 28. The air deflected by the louver 26*c* forms a cooling film over the downstream surface 28*b*. This provides a simple and economical way to increase the heat shield cooling effectiveness.

The floating collar 26 and the sealing ring 32 are assembled to the heat shield 28 from both sides, trapping the heat shield 28 when the floating collar 26 is mechanically attached to the sealing ring 32. The floating collar 26 is then swaged to provide a radially outwardly flaring end 26*c* opposite the louver 26*c* to facilitate the subsequent installation of the fuel nozzle 22 in the floating collar 26, as well as to provide retention of the floating collar 26 on the combustor shell 20 in the event of a brazing or welding failure between the sealing ring 32 and the collar 26.

The above description is meant to be exemplary only, and one skilled in the art will recognize that changes may be made to the embodiments described without departing from the scope of the invention disclosed. For example, the invention may be provided in any suitable heat shield configuration and in any suitable combustor configuration, and is not limited to application in turbofan engines. Still other modifications which fall within the scope of the present invention will be apparent to those skilled in the art, in light of a review of this disclosure, and such modifications are intended to fall within the appended claims.

What is claimed is:

1. A floating collar and heat shield assembly for allowing relative movement between a combustor and a fuel nozzle while providing sealing therebetween, comprising an axially extending floating collar body adapted to be mounted in a fuel nozzle opening defined in the combustor for movement with the fuel nozzle and providing sealing between the fuel nozzle and the combustor, the axially extending floating collar body defining a passage adapted to be aligned with the fuel nozzle opening for receiving the fuel nozzle, the floating collar body having a downstream end adapted to extend into the combustor, the downstream end being provided with a radially outwardly disposed annular louver, a heat shield adapted to be fixedly mounted to the combustor and fitted about said floating collar body upstream of said annular louver, said floating collar being movable relative to the heat shield and the combustor, said louver and said heat shield defining a controlled gap therebetween, and a sealing ring mounted to a radially outer surface of said floating collar body upstream of said heat shield and in sealing engagement therewith, the sealing ring being movable together with the floating collar relative to the heat shield, said sealing ring defining at least one hole for feeding cooling air to said controlled gap.

2. The floating collar and heat shield assembly defined in claim 1, wherein the louver and the floating collar body are of unitary construction and have the same material composition.

3. The floating collar and heat shield assembly defined in claim 1, wherein said controlled gap is connected in flow communication with said at least one hole through at least one passage extending from an upstream side of the heat shield to a downstream side thereof.

4. The floating collar and heat shield assembly defined in claim 1, wherein the sealing ring has a downstream surface abutted against an upstream side of the heat shield and a shoulder provided on the floating collar body.

5. The floating collar and heat shield assembly defined in claim 1, wherein said floating collar body has an upstream end opposite said downstream end thereof, said upstream end being adapted to extend outwardly of the combustor, the upstream end having a radially outwardly extending portion which is oversized relative to the fuel nozzle opening in order to provide a safety collar retention feature.

6. The floating collar and heat shield assembly defined in claim 1, wherein said heat shield defines a central aperture, said floating collar being radially movable within said central aperture.

7. A floating collar and heat shield assembly for gas turbine engine combustor, comprising a heat shield adapted to be mounted in the combustor, the heat shield defining a central aperture, a collar floatingly received in said central aperture for receiving a fuel nozzle, the central aperture accommodating radial excursion of said collar relative to the heat shield, the collar having a front end portion projecting forwardly of a front side of the heat shield and a rear end portion projecting rearwardly of a rear side of the heat shield, a cooling louver provided at said front end portion of said collar for directing a fluid cooling film along said front side of said heat shield, and a sealing ring provided at said rear end portion of the collar for sealing engagement with said rear side of said heat shield.

8. The floating collar and heat shield assembly defined in claim 7, wherein said cooling louver and said heat shield define a controlled gap therebetween, and wherein at least one cooling hole is defined in said sealing ring, said at least one cooling hole being in flow communication with said central aperture of said heat shield about said collar to feed said controlled gap.

9. The floating collar and heat shield assembly defined in claim 7, wherein said cooling louver is integral to said collar.

10. The floating collar and heat shield assembly defined in claim 7, wherein the sealing ring is securely mounted to the collar against a shoulder provided thereon.

11. The floating collar and heat shield assembly defined in claim 7, wherein said collar defines a central passage for axially slidably receiving a fuel nozzle.

12. The floating collar and heat shield assembly defined in claim 11, wherein the rear end portion of the collar flares radially outwardly.

13. A gas turbine engine combustor comprising a shell enclosing a combustion chamber, a fuel nozzle opening defined in the combustor shell, a floating collar movably mounted in said fuel nozzle opening and having a downstream end portion projecting into said combustion chamber, the floating collar defining an axial aperture, a fuel nozzle slidably engaged in said axial aperture, a heat shield fitted about said floating collar between the shell and a laterally extending louver integral to said downstream end portion of the floating collar, the floating collar being movable relative to the heat shield, the louver and the heat shield defining a controlled gap connected in flow communication with a source of coolant, the louver directing a film of coolant along a hot front surface of the heat shield.

14. The gas turbine engine combustor defined in claim 13, wherein a sealing ring is provided on the floating collar, the sealing ring being in sealing engagement with a rear surface of the heat shield.

15. The gas turbine engine combustor defined in claim 14, wherein at least one hole is defined in said sealing ring for allowing coolant to flow from the source of coolant to the controlled gap.

16. The gas turbine engine combustor defined in claim 13, wherein the heat shield is fixed to the combustor shell, and wherein the heat shield defines a collar receiving aperture sized to accommodate radial movement of the fuel nozzle and the floating collar relative to the shell.

17. A method of providing a floating collar and heat shield assembly, comprising: providing a collar body having first and second axially opposed ends, said first end having a radially outwardly extending flange; providing a heat shield having a central aperture having an inner diameter greater than an outer diameter of said collar body but smaller than said flange, loosely fitting said heat shield over said collar body from said second end opposite said flange, the collar body being movable relative to the heat shield, and trapping the heat shield between the flange and a sealing ring by mechanically attaching the sealing ring to the collar body.

18. The method defined in claim 17, further comprising outwardly flaring the second end of the collar body after the sealing ring has been mounted thereon.

19. The method defined in claim 17, comprising abutting the sealing ring against a shoulder defined in an outer surface of the collar body, and bonding the sealing ring to the collar body.

20. The method defined in claim 19 comprising integrally forming the collar body with the flange.

* * * * *